US010874002B2

(12) United States Patent
Hsu et al.

(10) Patent No.: US 10,874,002 B2
(45) Date of Patent: Dec. 22, 2020

(54) METHOD AND APPARATUS FOR COMPUTING ILLUMINATION MIXED LIGHTS, COMPUTER DEVICE AND STORAGE MEDIUM

(71) Applicant: DONGGUAN STAR MOUNT TRADING CO., LTD., Guangdong (CN)

(72) Inventors: Chen-Yuan Hsu, Dongguan (CN); Shou-Cheng Wu, Dongguan (CN)

(73) Assignee: DONGGUAN STAR MOUNT TRADING CO., LTD., Guangdong (CN)

( * ) Notice: Subject to any disclaimer, the term of this patent is extended or adjusted under 35 U.S.C. 154(b) by 0 days.

(21) Appl. No.: 16/420,182

(22) Filed: May 23, 2019

(65) Prior Publication Data

US 2020/0253009 A1 Aug. 6, 2020

Related U.S. Application Data

(63) Continuation of application No. PCT/CN2019/076130, filed on Feb. 26, 2019.

(30) Foreign Application Priority Data

Feb. 1, 2019 (CN) ..... 2019 1 0105677

(51) Int. Cl.
*H05B 45/20* (2020.01)
*H05B 47/155* (2020.01)

(52) U.S. Cl.
CPC ..... *H05B 45/20* (2020.01); *H05B 47/155* (2020.01)

(58) Field of Classification Search
CPC ..... H05B 45/20; H05B 47/155
See application file for complete search history.

(56) References Cited

U.S. PATENT DOCUMENTS 6,630,801 B2 * 10/2003 Schuurmans ..... H05B 45/22 315/307
2007/0013057 A1 1/2007 Mazzochette
(Continued)

FOREIGN PATENT DOCUMENTS

CN 103889101 6/2014
CN 104093247 10/2014
(Continued)

OTHER PUBLICATIONS

"International Search Report (Form PCT/ISA/210) of PCT/CN2019/076130," dated Oct. 9, 2019, pp. 1-4.
(Continued)

*Primary Examiner* — Borna Alaeddini
(74) *Attorney, Agent, or Firm* — JCIPRNET

(57) ABSTRACT

The present application relates to a method for computing illumination mixed lights. The method includes the following. Acquire a first chromaticity coordinate point corresponding to a first colored light, and acquire a second chromaticity coordinate point corresponding to a second colored light. Acquire a target chromaticity coordinate point, and compute a first lumen mixing ratio of the first colored light and the second colored light. Determine a middle chromaticity coordinate point corresponding to a middle-colored light obtained by mixing according to the first lumen mixing ratio. Determine a first compensation colored light and a second compensation colored light which are matched with the middle chromaticity coordinate point. Conduct compensation computation on the middle colored light, and determine a second lumen mixing ratio corresponding to the first compensation colored light, the second compensation colored light and the middle colored light when mixed to the target chromaticity coordinate point.

15 Claims, 12 Drawing Sheets

(56) References Cited

U.S. PATENT DOCUMENTS

| | | | | |
|---|---|---|---|---|
| 2011/0006707 | A1 | 1/2011 | Baaijens | |
| 2011/0309755 | A1* | 12/2011 | Wirth | H05B 45/20 315/151 |
| 2012/0019164 | A1* | 1/2012 | Gambeski | H05B 45/20 315/294 |
| 2013/0009564 | A1* | 1/2013 | Kaihotsu | H05B 45/20 315/250 |
| 2013/0293147 | A1* | 11/2013 | Rogers | H05B 45/20 315/297 |
| 2018/0150760 | A1 | 5/2018 | Sarpeshkar | |

FOREIGN PATENT DOCUMENTS

| | | | | |
|---|---|---|---|---|
| CN | 105042365 | | 11/2015 | |
| CN | 106162981 | | 11/2016 | |
| CN | 104300045 | | 3/2017 | |
| CN | 107333359 | | 11/2017 | |
| CN | 107896398 | | 4/2018 | |
| CN | 108463024 | | 8/2018 | |
| CN | 106102248 | | 1/2019 | |
| DE | 102011075116 | A1 * | 11/2012 | F21S 19/005 |
| EP | 1947866 | | 9/2010 | |
| EP | 1356424 | | 7/2015 | |

OTHER PUBLICATIONS

Albert T. L. Lee, et al., "Precise Dimming and Color Control of LED Systems Based on Color Mixing," IEEE Transactions on Power Electronics, vol. 31, Jan. 2016, pp. 1-17.

"Notice of Allowance of Taiwan Counterpart Application", dated May 29, 2020, pp. 1-3.

* cited by examiner

METHOD AND APPARATUS FOR COMPUTING ILLUMINATION MIXED LIGHTS, COMPUTER DEVICE AND STORAGE MEDIUM

CROSS-REFERENCE TO RELATED APPLICATIONS

This application is a continuation of international PCT application serial no. PCT/CN2019/076130, filed on Feb. 26, 2019, which claims the priority benefit of China application no. 201910105677.4, filed on Feb. 1, 2019. The entirety of each of the above-mentioned patent applications is hereby incorporated by reference herein and made a part of this specification.

TECHNICAL FIELD

The present invention relates to the field of computer processing, and more particularly relates to a method and apparatus for computing illumination mixed lights, a computer device and a storage medium.

BACKGROUND ART

Two mixed colored light is adopted in the traditional method for computing illumination mixed lights, and the obtained mixed colored light is on a straight line of two points no matter how the two-colored lights are mixed. Many points deviate from a point defined in Energy Star, resulting in color tolerance. The color tolerance acceptable to human eyes is within 3SDCM (McAdam ellipse).

However, the traditional method for computing illumination mixed lights is not accurate, and the color tolerance generated by mixing the lights according to this traditional method will be greater than 3SDCM, resulting in poor light mixing effect.

SUMMARY OF THE INVENTION

Based on this, it is necessary to provide a method and apparatus for computing illumination mixed lights capable of reducing color tolerance and enhancing light mixing effect, a computer device and a storage medium with respect to the above problems.

In a first aspect, an embodiment of the present invention provides a method for computing illumination mixed lights, including:

acquiring a first chromaticity coordinate point corresponding to a first colored light, and acquiring a second chromaticity coordinate point corresponding to a second colored light;

acquiring a target chromaticity coordinate point, and computing a first lumen mixing ratio of the first colored light and the second colored light according to the target chromaticity coordinate point, the first chromaticity coordinate point and the second chromaticity coordinate point;

determining a middle chromaticity coordinate point corresponding to a middle-colored light obtained by mixing the first colored light and the second colored light according to the first lumen mixing ratio;

determining a first compensation colored light and a second compensation colored light which are matched with the middle chromaticity coordinate point according to the middle chromaticity coordinate point; and conducting compensation computation on the middle-colored light according to the first compensation colored light and the second compensation colored light, and determining a second lumen mixing ratio corresponding to the first compensation colored light, the second compensation colored light and the middle colored light when mixed to the target chromaticity coordinate point.

In a second aspect, an embodiment of the present invention provides an apparatus for computing illumination mixed lights, including:

a coordinate point acquiring module configured for acquiring a first chromaticity coordinate point corresponding to a first colored light and acquiring a second chromaticity coordinate point corresponding to a second colored light;

a ratio computing module configured for acquiring a target chromaticity coordinate point and computing a first lumen mixing ratio of the first colored light and the second colored light according to the target chromaticity coordinate point, the first chromaticity coordinate point and the second chromaticity coordinate point;

a coordinate point determining module configured for determining a middle chromaticity coordinate point corresponding to a middle-colored light obtained by mixing the first colored light and the second colored light according to the first lumen mixing ratio;

a compensation colored light determining module configured for determining a first compensation colored light and a second compensation colored light which are matched with the middle chromaticity coordinate point according to the middle chromaticity coordinate point; and a ratio determining module configured for conducting compensation computation on the middle colored light according to the first compensation colored light and the second compensation colored light and determining a second lumen mixing ratio corresponding to the first compensation colored light, the second compensation colored light and the middle colored light when mixed to the target chromaticity coordinate point.

In a third aspect, an embodiment of the present invention provides a computer device, including a memory and a processor, wherein the memory stores computer programs that, when executed by the processor, enable the processor to execute the steps of:

acquiring a first chromaticity coordinate point corresponding to a first colored light, and acquiring a second chromaticity coordinate point corresponding to a second colored light;

acquiring a target chromaticity coordinate point, and computing a first lumen mixing ratio of the first colored light and the second colored light according to the target chromaticity coordinate point, the first chromaticity coordinate point and the second chromaticity coordinate point;

determining a middle chromaticity coordinate point corresponding to a middle-colored light obtained by mixing the first colored light and the second colored light according to the first lumen mixing ratio;

determining a first compensation colored light and a second compensation colored light which are matched with the middle chromaticity coordinate point according to the middle chromaticity coordinate point; and conducting compensation computation on the middle-colored light according to the first compensation colored light and the second compensation colored light, and determining a second lumen mixing ratio corresponding to the first compensation colored light, the second compensation colored light and the middle colored light when mixed to the target chromaticity coordinate point.

In a fourth aspect, an embodiment of the present invention provides a computer readable storage medium, storing computer programs that, when executed by the processor, enable the processor to execute the steps of:

acquiring a first chromaticity coordinate point corresponding to a first colored light, and acquiring a second chromaticity coordinate point corresponding to a second colored light;

acquiring a target chromaticity coordinate point, and computing a first lumen mixing ratio of the first colored light and the second colored light according to the target chromaticity coordinate point, the first chromaticity coordinate point and the second chromaticity coordinate point;

determining a middle chromaticity coordinate point corresponding to a middle-colored light obtained by mixing the first colored light and the second colored light according to the first lumen mixing ratio;

determining a first compensation colored light and a second compensation colored light which are matched with the middle chromaticity coordinate point according to the middle chromaticity coordinate point; and conducting compensation computation on the middle-colored light according to the first compensation colored light and the second compensation colored light, and determining a second lumen mixing ratio corresponding to the first compensation colored light, the second compensation colored light and the middle colored light when mixed to the target chromaticity coordinate point.

In the above method and apparatus for computing illumination mixed lights, the computer device and the storage medium, firstly, the first lumen mixing ratio of the first colored light and the second colored light is determined according to the target chromaticity coordinate point; the middle colored light obtained according to the first lumen mixing ratio has a large color tolerance; then, the first compensation colored light and the second compensation colored light are matched according to the middle chromaticity coordinate point; compensation computation is conducted on the middle colored light; and the second lumen mixing ratio corresponding to the first compensation colored light, the second compensation colored light and the middle colored light is determined when mixed to the target chromaticity coordinate point. The first colored light, the second colored light, the first compensation colored light and the second compensation colored light are mixed according to the computed first lumen mixing ratio and the second lumen mixing ratio so that the target chromaticity coordinate point can be completely mixed, thereby greatly reducing the color tolerance and enhancing the light mixing effect.

BRIEF DESCRIPTION OF THE DRAWINGS

In order to more clearly describe the embodiment of the present invention or the technical solution in the prior art, drawings to be used in the describing the embodiment or the prior art will be introduced briefly. Apparently, the drawings described below are only some embodiments of the present invention. For those ordinary skilled in the art, other drawings can also be obtained according to the structures shown by these drawings without contributing creative labor.

DETAILED DESCRIPTION OF THE INVENTION

For the purpose of making objects, technical solutions and advantages of the present application clearer, the present application is further described in detail below in conjunction with drawings and embodiments. It should be understood that the described specific embodiments are merely used to explain the present invention and not to limit present invention.

Figure 1:
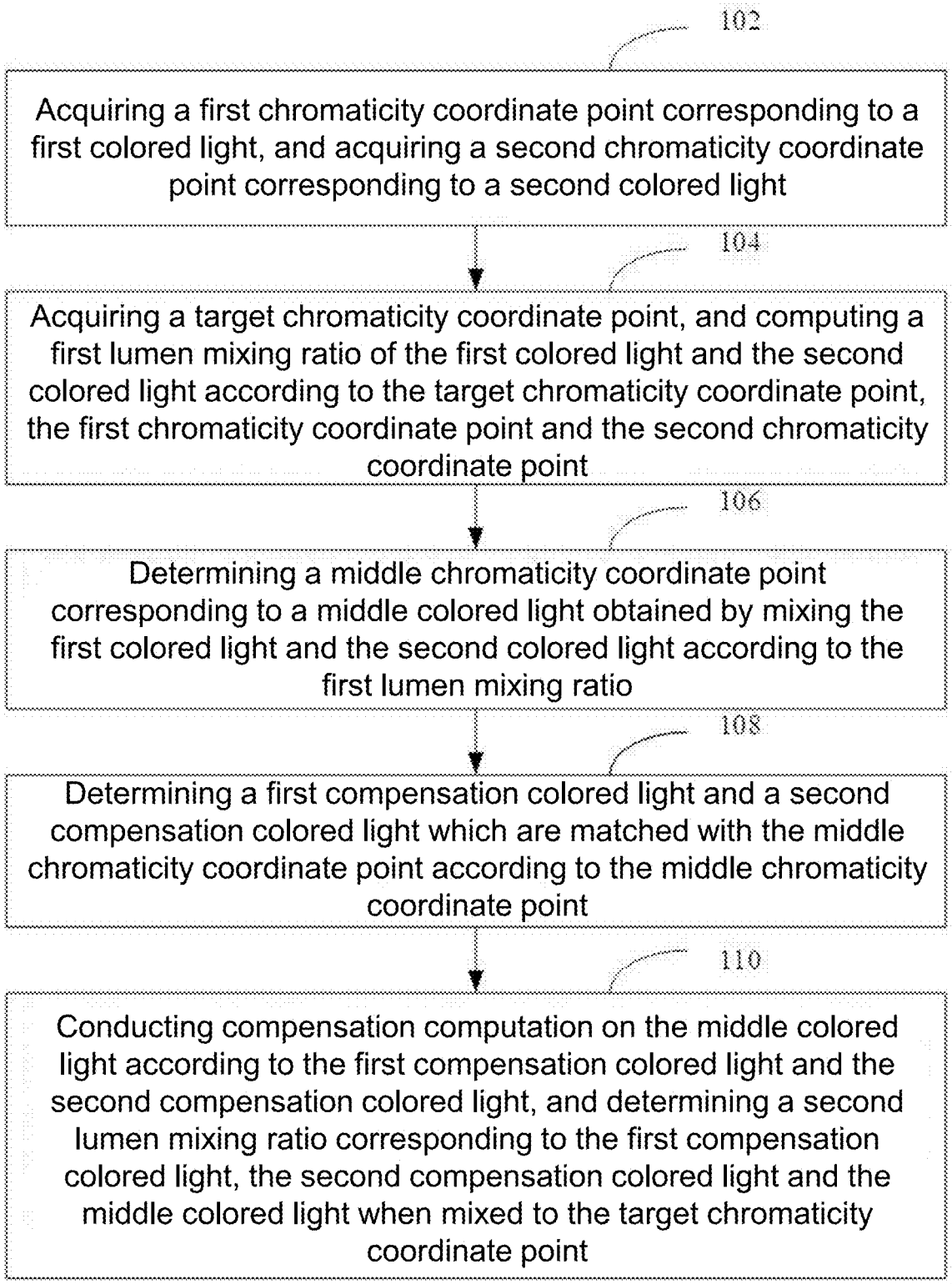
FIG. 1 is a flow chart of a method for computing illumination mixed lights in one embodiment.

As shown in FIG. 1, a method for computing illumination mixed lights is provided. The method for computing illumination mixed lights can be applied to a computer device, and specifically includes the following steps:

Step 102: acquiring a first chromaticity coordinate point corresponding to a first colored light, and acquiring a second chromaticity coordinate point corresponding to a second colored light.

Figure 2:
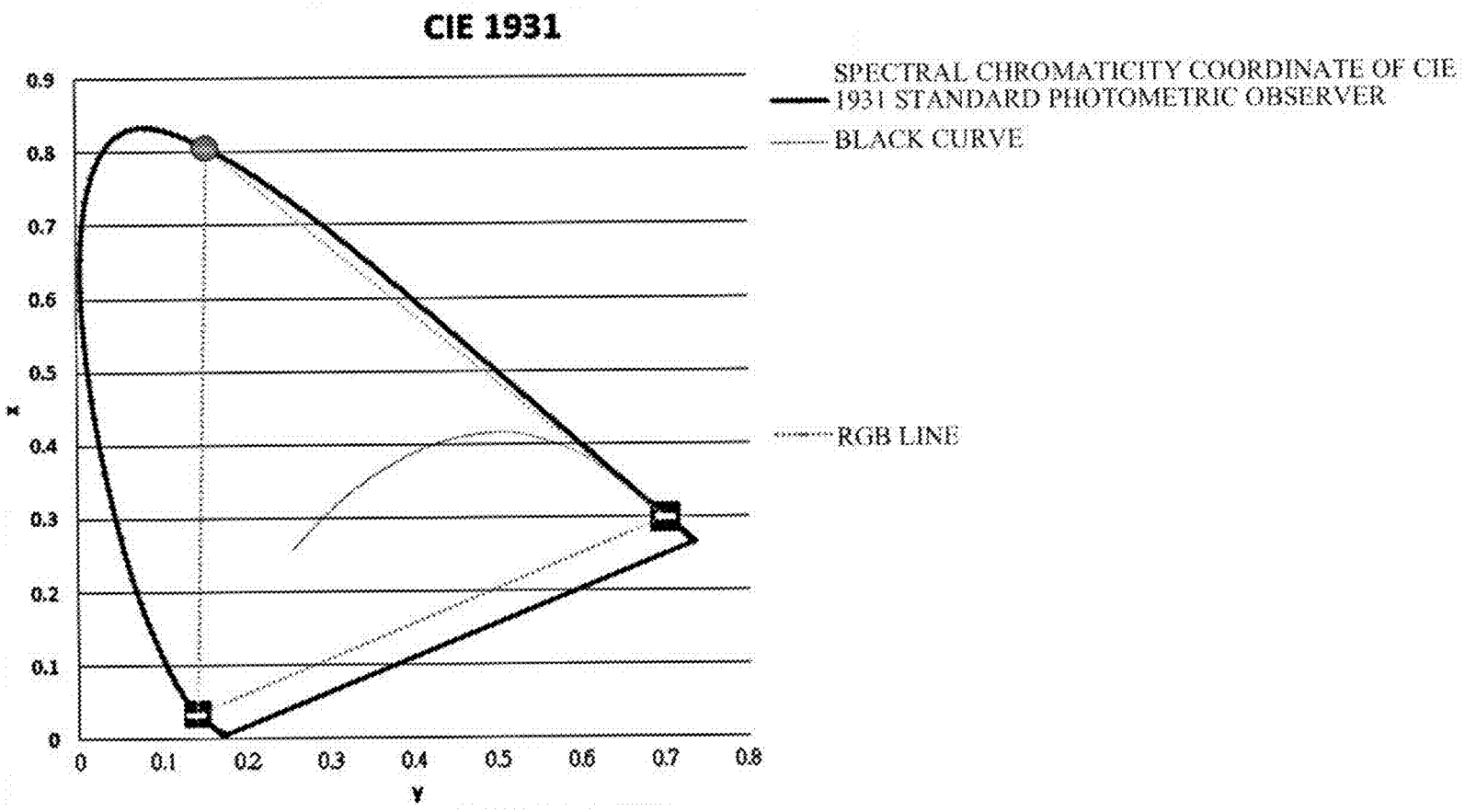
FIG. 2 is a schematic diagram of a CIE 1931 chromaticity coordinate graph in one embodiment.

Different colored lights correspond to different chromaticity coordinate points. FIG. 2 shows a CIE 1931 chromaticity coordinate graph. In the figure, a corresponding coordinate of each point is called a "chromaticity coordinate point". CIE 1931 is a set of technical standards for the definition and measurement of color established by the International Commission on Illumination. A first colored light is different from a second colored light. For distinguishing, a chromaticity coordinate point of the first colored light is called a "first chromaticity coordinate point" and a chromaticity coordinate point of the second colored light is called a "second chromaticity coordinate point".

Chromaticity coordinate means a coordinate of a color, with x for a transverse axis and y for a vertical axis. With the chromaticity coordinate, a single point can be identified uniquely on a chromaticity map. This point accurately represents a light emitting color. In addition to x and y, the color temperature can also be used to represent the light emitting color of an illumination light source. In one embodiment, the first colored light is warm white, and the second colored light is cool white. The determination of the first chromaticity coordinate point and the second chromaticity coordinate point can be obtained by finding a factory specification of an LED light source that emits the corresponding colored light. In order to be more accurate, the chromaticity coordinate points can also be measured by a measuring device (for example, an integrating ball).

Step 104: acquiring a target chromaticity coordinate point, and computing a first lumen mixing ratio of the first colored light and the second colored light according to the target chromaticity coordinate point, the first chromaticity coordinate point and the second chromaticity coordinate point.

The target chromaticity coordinate point means a coordinate point corresponding to a target colored light to be obtained by mixing lights. The target chromaticity coordinate point can be customized according to actual needs. For example, in order to reduce color tolerance, the target chromaticity coordinate point is defined as a point on Energy Star, and of course, can also be defined as a point on a Planckian locus curve and any custom point. After the target chromaticity coordinate point is determined, the mixing ratio of the first colored light and the second colored light can be computed according to a color mixing principle. The mixing ratio essentially means a lumen mixing ratio. In order to distinguish from a subsequent mixing ratio, the mixing ratio is called a "first lumen mixing ratio". The lumen is a luminous flux. Because the luminous flux is in the unit of lm, the luminous flux is also called "lumen".

In one embodiment, tristimulus values in the mathematical theory of color mixing can be written as follows:

$$X=x*(Y/y);Y=Y;Z=(Y/y)*(1-x-y)$$

In the formula, x and y are respectively a horizontal coordinate and a vertical of a chromaticity coordinate point, and X, Y and Z are respectively the tristimulus values. A final color obtained by mixing depends on the tristimulus values. The following is an example of mixing two colored lights:

$$X\text{mix}=X1+X2;Y\text{mix}=Y1+Y2;Z\text{mix}=Z1+Z2$$

Then, the following is obtained by mixing:

$$x\text{mix}=X\text{mix}/(X\text{mix}+Y\text{mix}+Z\text{mix})$$

$$y\text{mix}=Y\text{mix}/(X\text{mix}+Y\text{mix}+Z\text{mix})$$

$$\varphi\text{mix}=Y\text{mix}.$$

X1, Y1 and Z1 are tristimulus values corresponding to the first colored light, and X2, Y2 and Z2 are tristimulus values corresponding to the second colored light. xmix and ymix are chromaticity coordinate points obtained by mixing, i.e., x value and y value of the middle chromaticity coordinate point. φmix is a luminous flux (lumen) obtained by mixing. Therefore, if the target chromaticity coordinate point, the first chromaticity coordinate point and the second chromaticity coordinate point are known, the mixing ratio of the first colored light and the second colored light can be computed.

Figure 3A:
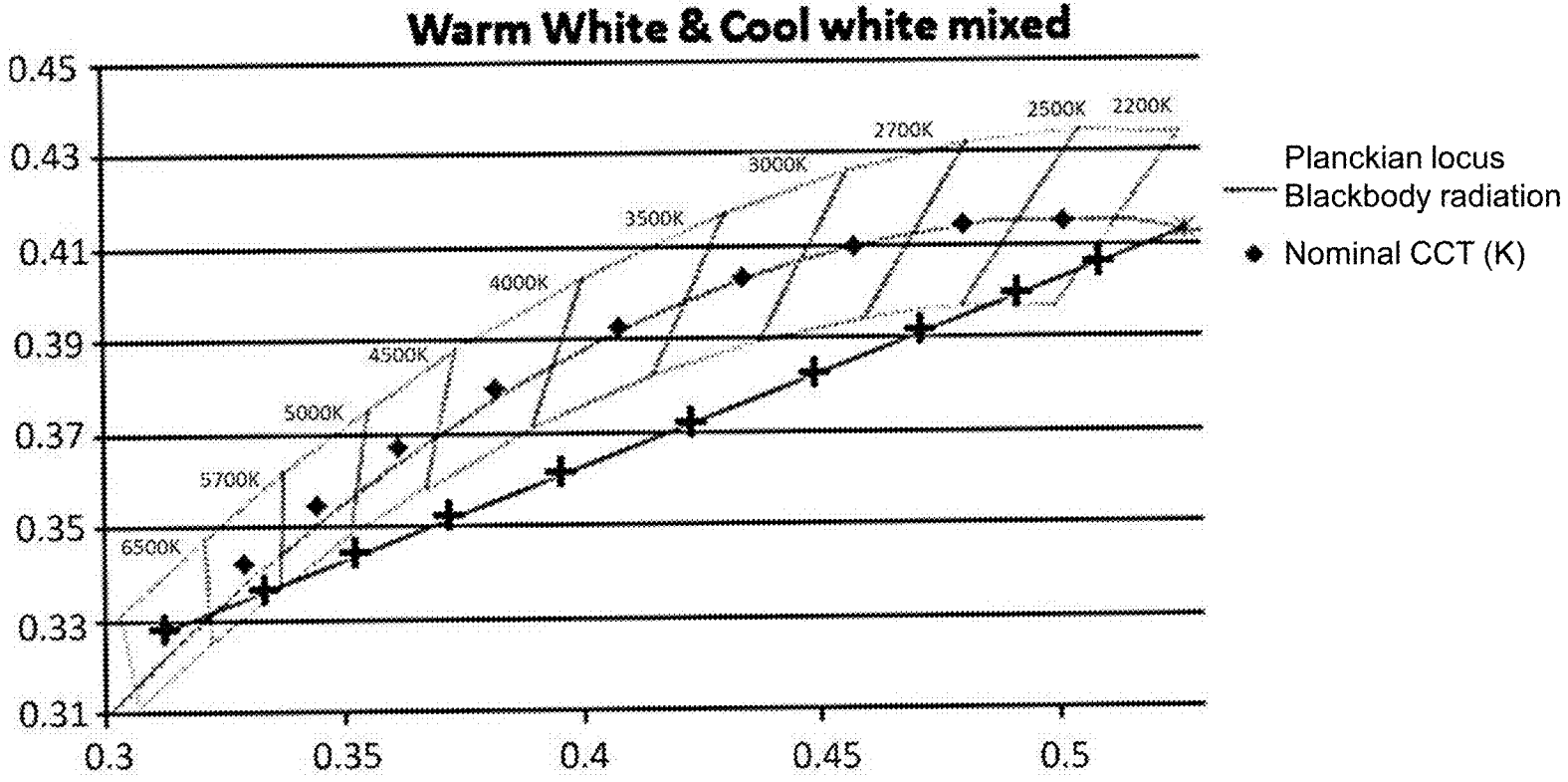
FIG. 3A is a schematic diagram of mixing warm white and cool white in one embodiment.
Figure 3B:
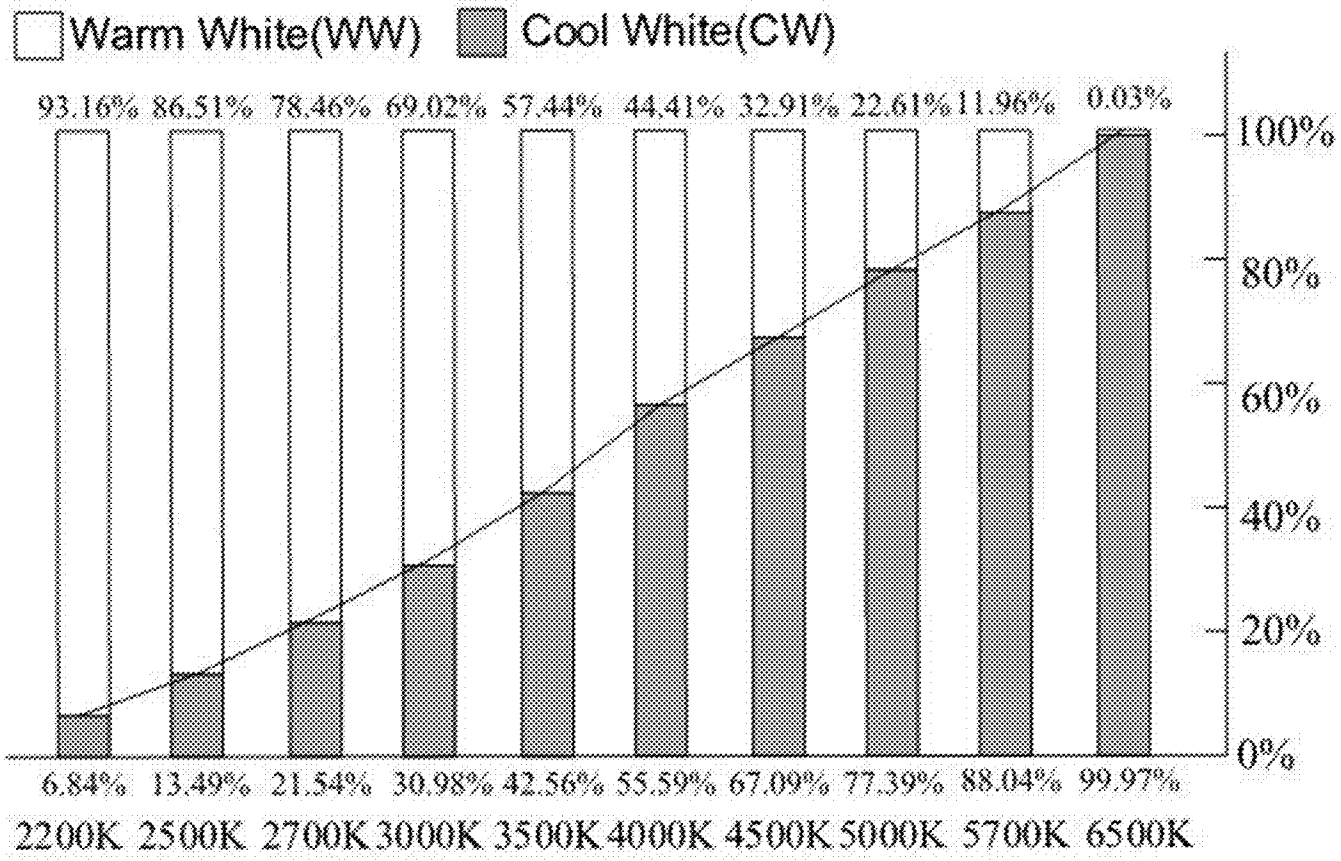
FIG. 3B is a schematic diagram of a mixing ratio corresponding to a different color temperature obtained by mixing in one embodiment.

In one embodiment, the first colored light may be selected from warm white (such as colored light with a color temperature of 2700K), and the second colored light may be selected from cool white (such as colored light with a color temperature of 6500K). FIG. 3A is a schematic diagram of mixing warm white and cool white in one embodiment. As shown in FIG. 3A, the middle-colored light obtained by two mixed colored lights can only be on a two-point straight line (i.e., a straight line where a cross is located in the figure). Therefore, when the target chromaticity coordinate point is outside the two-point straight line, the obtained first lumen mixing ratio cannot be very accurate, and there will be a certain color tolerance between the middle-colored light obtained by subsequent light mixing and the target colored light. FIG. 3B is a schematic diagram of a mixing ratio corresponding to a different color temperature obtained by mixing, i.e., a different mixing ratio. Mixing coordinate points obtained are different. The horizontal coordinate in the figure is represented by the color temperature, and different color temperatures correspond to different chromaticity coordinate points.

Step 106: determining a middle chromaticity coordinate point corresponding to a middle-colored light obtained by mixing the first colored light and the second colored light according to the first lumen mixing ratio.

The middle chromaticity coordinate point means a chromaticity coordinate point corresponding to the middle-colored light obtained by mixing the first colored light and the second colored light according to the "first lumen mixing ratio". Because the middle colored light obtained by two mixed colored lights can only be on the two-point straight line, if the target chromaticity coordinate point is not on the two-point straight line, then there will be a certain deviation between the middle chromaticity coordinate point of the obtained middle colored light and the target chromaticity coordinate point. Thus, it is necessary to separately compute the middle chromaticity coordinate point corresponding to the middle-colored light.

Step 108: determining a first compensation colored light and a second compensation colored light which are matched with the middle chromaticity coordinate point according to the middle chromaticity coordinate point.

After the middle chromaticity coordinate point corresponding to the middle-colored light is obtained, in order to reduce the color tolerance, it is necessary to compensate the middle-colored light into the target colored light. The first compensation colored light and the second compensation colored light matched with the middle chromaticity coordinate point are selected according to the middle chromaticity coordinate point of the middle-colored light. The first compensation colored light and the second compensation colored light may be selected from red, green, blue and other basic colored lights, and of course, can also be selected from other colored lights. As long as the color gamut range determined by the selected first compensation colored light, the second compensation colored light, the first colored light and the second colored light includes the target chromaticity coordinate point and the middle chromaticity coordinate point, the target colored light can be mixed. In one embodiment, two colored lights are respectively selected from three basic colored lights of red, green and blue according to the position relationship between the middle chromaticity coordinate point and the target chromaticity coordinate point as the first compensation colored light and the second compensation colored light.

Step 110: conducting compensation computation on the middle colored light according to the first compensation colored light and the second compensation colored light, and determining a second lumen mixing ratio corresponding to the first compensation colored light, the second compensation colored light and the middle colored light when mixed to the target chromaticity coordinate point.

After the first compensation colored light and the second compensation colored light are determined, a first compensation chromaticity coordinate point corresponding to the first compensation colored light and a second compensation chromaticity coordinate point corresponding to the second compensation colored light are acquired, and a mixing ratio, i.e., a second lumen mixing ratio corresponding to the first compensation colored light, the second compensation colored light and the middle colored light when mixed to the target chromaticity coordinate point is computed according to the first compensation chromaticity coordinate point, the second compensation chromaticity coordinate point and the middle chromaticity coordinate point. The first compensation colored light, the second compensation colored light and the middle-colored light are mixed according to the second lumen mixing ratio to mix a target colored light corresponding to the target chromaticity coordinate point. The color tolerance of the mixed target colored light can be reduced to be within 1SCDM which cannot be perceived by human eyes, thereby greatly enhancing the light mixing effect.

In the above method for computing illumination mixed lights, firstly, the first lumen mixing ratio of the first colored light and the second colored light is determined according to the target chromaticity coordinate point; then, the first colored light and the second colored light are mixed to obtain the middle colored light; because the middle colored light has a large color tolerance, the first compensation colored light and the second compensation colored light are matched continuously according to the middle chromaticity coordinate point; compensation computation is conducted on the middle colored light; and the second lumen mixing ratio corresponding to the first compensation colored light, the second compensation colored light and the middle colored light is determined when mixed to the target chromaticity coordinate point. The first colored light, the second colored light, the first compensation colored light and the second compensation colored light are mixed according to the first lumen mixing ratio and the second lumen mixing ratio so that the target chromaticity coordinate point can be completely mixed, thereby greatly reducing the color tolerance and enhancing the light mixing effect.

In one embodiment, the step of determining a first compensation colored light and a second compensation colored light which are matched with the middle chromaticity coordinate point according to the middle chromaticity coordinate point includes: acquiring a third chromaticity coordinate point corresponding to a third colored light, a fourth chromaticity coordinate point corresponding to a fourth colored light and a fifth chromaticity coordinate point corresponding to a fifth colored light; determining a color gamut range of the target chromaticity coordinate point according to the third chromaticity coordinate point, the fourth chromaticity coordinate point, the fifth chromaticity coordinate point and the middle chromaticity coordinate point; and selecting two colored lights as the first compensation colored light and the second compensation colored light from the third colored light, the fourth colored light and the fifth colored light according to the color gamut range.

Figure 4:
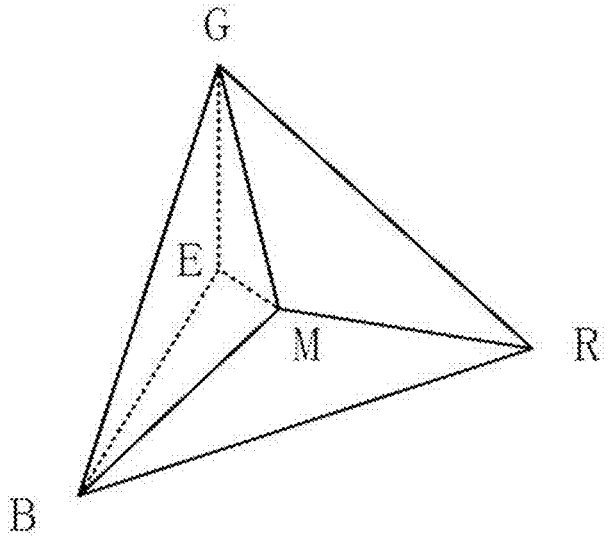
FIG. 4 is a schematic diagram of three-color gamut ranges in one embodiment.

The third colored light, the fourth colored light and the fifth colored light form a large color gamut region. The middle chromaticity coordinate point falls into the large color gamut region, and target chromaticity coordinate point also falls into the large color gamut region. In order to compensate the middle-colored light to obtain the target colored light, firstly, it is necessary to determine which small color gamut range the target colored light falls into. The large color gamut region is divided into three small color gamut ranges according to the chromaticity coordinate points of the third colored light, the fourth colored light, the fifth colored light and the middle-colored light. In one embodiment, a schematic diagram of dividing into three small color gamut ranges is shown in FIG. 4. Three small color gamut ranges are respectively a triangle RBM, a triangle RGM and a triangle BGM. In order to compensate the middle-colored light to obtain the target colored light, it is necessary to determine which small color gamut range the target colored light falls into. Then, two colored lights are selected from the three colored lights as the first compensation colored light and the second compensation colored light according to the color gamut ranges. For example, if the target colored light falls into the RBM range in the figure, then R and B are selected as the first compensation colored light and the second compensation colored light respectively.

In one embodiment, the color gamut range of the target chromaticity coordinate point is determined according to the third chromaticity coordinate point, the fourth chromaticity coordinate point, the fifth chromaticity coordinate point and the middle chromaticity coordinate point includes: respectively computing triangle areas formed by any three points of the third chromaticity coordinate point, the fourth chromaticity coordinate point, the fifth chromaticity coordinate point, the middle chromaticity coordinate point and the target chromaticity coordinate point; determining a target triangle area matched with the target chromaticity coordinate point according to the computed triangle areas; and using the target triangle area as the color gamut range corresponding to the target chromaticity coordinate point.

In order to compute the color gamut range corresponding to the target chromaticity coordinate point, the triangle areas formed by any three points of the third chromaticity coordinate point, the fourth chromaticity coordinate point, the fifth chromaticity coordinate point, the middle chromaticity coordinate point and the target chromaticity coordinate point are respectively computed. Any three points are selected from five points. Ten triangles are obtained through permutation and combination to compute the areas of the ten triangles respectively.

In one embodiment, the third colored light, the fourth colored light and the fifth colored light are respectively three basic colored lights of red (R), green (G) and blue (B). As shown in FIG. 4, E indicates the target chromaticity coordinate point of the target colored light and M indicates the middle chromaticity coordinate point of the mixed middle colored light. If E falls into the triangle BGM, then "the area of the triangle BEG+the area of the triangle GEM+the area of the triangle BEM=the area of the triangle BGM" is certainly obtained. Therefore, the target triangle area matched with the target chromaticity coordinate point can be obtained according to the relationship of the computed triangle areas. The target triangle area is taken as the color gamut range corresponding to the target chromaticity coordinate point.

In one embodiment, the steps of conducting compensation computation on the middle colored light according to the first compensation colored light and the second compensation colored light and determining a second lumen mixing ratio corresponding to the first compensation colored light, the second compensation colored light and the middle colored light when mixed to the target chromaticity coordinate point includes: acquiring a first compensation chromaticity coordinate point of the first compensation colored light, and acquiring a second compensation chromaticity coordinate point of the second compensation colored light; and determining a second lumen mixing ratio corresponding to the first compensation colored light, the second compensation colored light and the middle colored light when mixed to the target chromaticity coordinate point according to the first compensation chromaticity coordinate point, the second compensation chromaticity coordinate point and the middle chromaticity coordinate point.

After the first compensation colored light and the second compensation colored light are determined, the first compensation chromaticity coordinate point corresponding to the first compensation colored light and the second compensation chromaticity coordinate point corresponding to the second compensation colored light are respectively acquired. Then, by taking the target chromaticity coordinate point as a target point, the first compensation colored light, the second compensation colored light and the middle-colored light are used as colored lights with known coordinates. Then, the second lumen mixing ratio corresponding to the first compensation colored light, the second compensation colored light and the middle-colored light can be obtained through computation. As long as the lights are mixed according to the second lumen mixing ratio, the target colored light corresponding to the target chromaticity coordinate point can be obtained.

In one embodiment, the method for computing illumination mixed lights further includes: acquiring a color temperature corresponding to the target chromaticity coordinate point, and acquiring a mixing ratio of the first colored light, the second colored light, the first compensation colored light and the second compensation colored light corresponding to the target colored light; and conducting associative storage on the color temperature and the corresponding mixing ratio.

After the target chromaticity coordinate point is obtained, the color temperature corresponding to the target chromaticity coordinate point is acquired, and then a mixing ratio of the first colored light, the second colored light, the first compensation colored light and the second compensation colored light corresponding to the target colored light is acquired. Namely, the final mixing ratio of the first colored light, the second colored light, the first compensation colored light and the second compensation colored light is computed according to the first lumen mixing ratio and the second lumen mixing ratio. Associative storage is conducted on the color temperature and the corresponding mixing ratio. When it is necessary to obtain the target colored light corresponding to the color temperature, the mixing ratio corresponding to the color temperature is acquired, and then the first colored light, the second colored light, the first compensation colored light, and the second compensation colored light are mixed in accordance with the mixing ratio, so as to obtain the target colored light corresponding to the color temperature.

In one embodiment, the method for computing illumination mixed lights further includes: determining a target color temperature corresponding to the current illumination according to a preset condition, and determining a target mixing ratio corresponding to the target color temperature according to the correspondence between the color temperature and the mixing ratio; and mixing the first colored light, the second colored light, the first compensation colored light and the second compensation colored light according to the target mixing ratio to obtain the target colored light corresponding to the target color temperature.

In an illumination application scenario, the color temperature corresponding to the current illumination needs to be determined in real time in order for the illumination to be able to change over time or automatically adjust with the outside illumination intensity. For example, if the illumination light can change with time, for example, the color temperature from 8 to 9 o'clock in the morning is set to 2700K, and the color temperature from 9 to 10 o'clock is set to 3000K, etc., then the target color temperature of the current illumination can be determined after the current time is acquired. Then the target mixing ratio corresponding to the target color temperature is determined according to the correspondence between a pre-stored color temperature and the mixing ratio. Then, the first colored light, the second colored light, the first compensation colored light and the second compensation colored light are mixed according to the target mixing ratio.

In one embodiment, the step of determining a middle chromaticity coordinate point corresponding to a middle colored light obtained by mixing the first colored light and the second colored light according to the first lumen mixing ratio includes: acquiring a target lumen value, and determining a first lumen value corresponding to the first colored light and a second lumen value corresponding to the second colored light according to the target lumen and the first lumen mixing ratio; and determining a middle chromaticity coordinate point corresponding to the middle colored light obtained by mixing the first colored light and the second colored light according to the first lumen and the second lumen.

If a set target lumen is acquired, under the condition that the first lumen mixing ratio is known, the lumen corresponding to the first colored light and the lumen corresponding to the second colored light can be determined and then mixed to obtain the middle-colored light. Because the lumen ratio of the first colored light and the second colored light can only be obtained according to the first chromaticity coordinate point, the second chromaticity coordinate point and the target chromaticity coordinate point, then the specific lumens of the first colored light and the second colored light can be computed after the target lumen is given; and then the first lumen and the second lumen are computed and the middle chromaticity coordinate point corresponding to the mixed middle colored light can be computed.

In one embodiment, the first lumen mixing ratio and the second lumen mixing ratio are computed through the above method for computing illumination mixed lights. The mixing ratio corresponding to the first colored light, the second colored light, the first compensation colored light and the second compensation colored light is obtained according to the first lumen mixing ratio and the second lumen mixing ratio. Actual light mixing is guided according to the mixing ratio to greatly reduce the color tolerance of the obtained target colored light.

Figure 5:
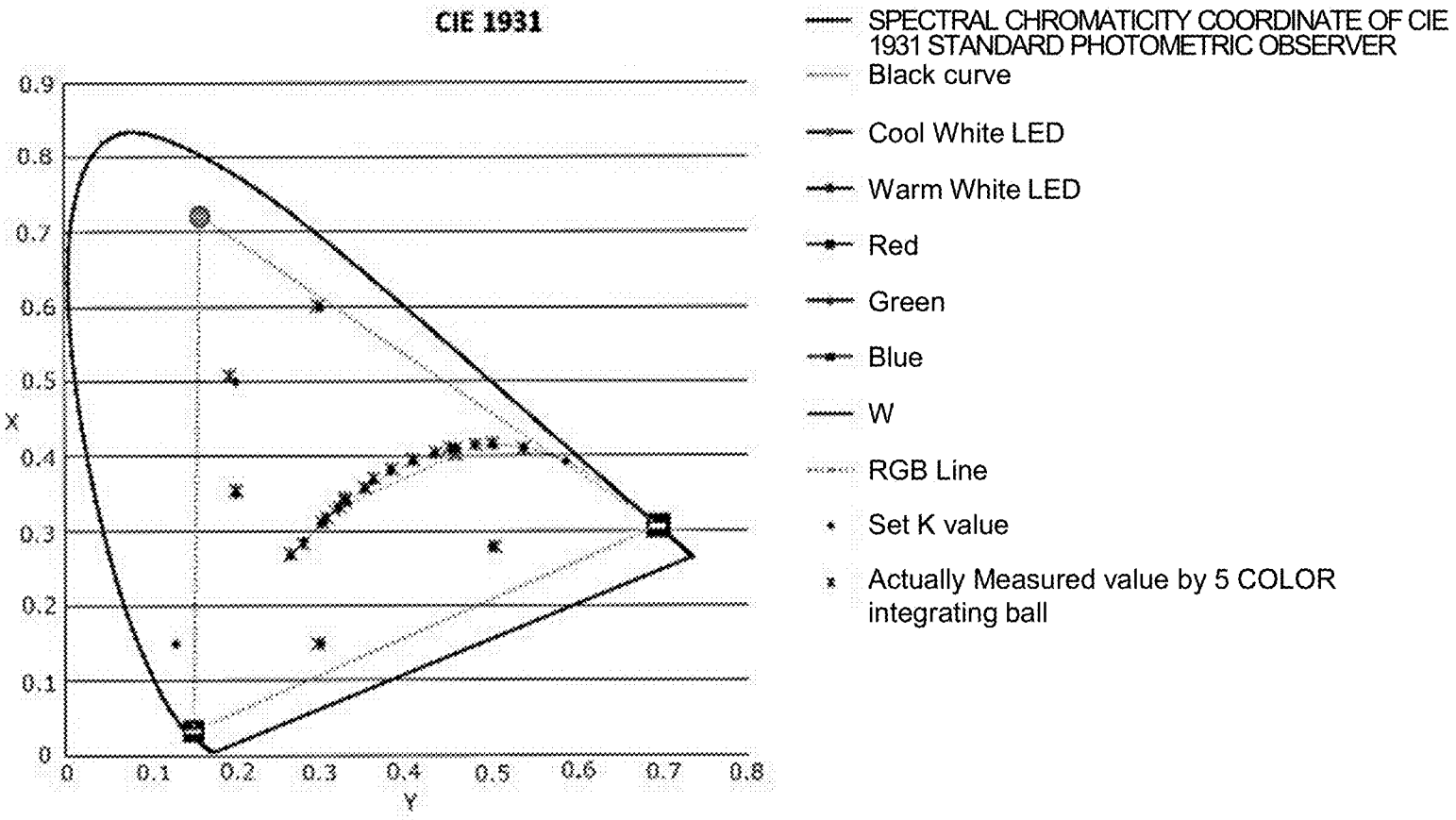
FIG. 5 is a result schematic diagram of experimental verification for a method for computing illumination mixed lights in one embodiment.

In one experimental verification, RGBWW (R red light, G green light, B blue light, W warm white and W cool white) 5-color temperature LED is used with 256 bit as division and 125 bits as the benchmark data; with a 0-255 controller, RGBWW 5 LEDs are divided into required current values using the PWM (pulse width modulation) principle. After the LEDs, the required lumens are transmitted. Then, the obtained target colored light is adjusted according to the set lumens of five-path colored lights. By comparing the chromaticity coordinate point measured by an integrating sphere with the target chromaticity coordinate point, it is found that they are very close. FIG. 5 is a result schematic diagram of experimental verification for a method for computing illumination mixed lights in one embodiment. The chromaticity coordinate point (star point) obtained by an experiment basically coincides with the target chromaticity coordinate point, and the color tolerance is within 1SCDM. The color tolerance is used to characterize the difference between the x and y values of a light color detection system and a standard light source. If the color tolerance is smaller, the accuracy is higher. The color tolerance is a distance from the measured coordinate value (x1, y1) of the LED light source to the target value of the standard chromaticity coordinate. SCDM can be computed by the following formula:

$$SCDM=(g11*\Delta x*\Delta x+2g12*\Delta x*\Delta y+g22*\Delta y*\Delta y)^{1/2}$$

where Δx represents an error of x1 value relative to the target value; and Δy represents an error of y1 value relative to the target value. g11, g12 and g22 are coefficients determined by standard colors.

Figure 6:
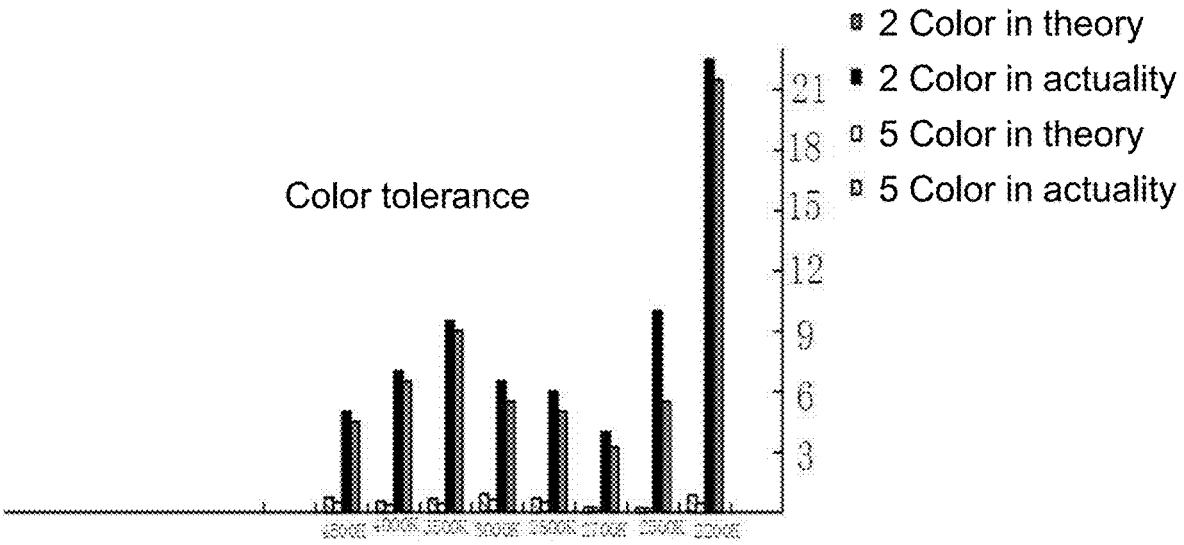
FIG. 6 is a result comparison schematic diagram of experimental verification in one embodiment.

FIG. 6 is a schematic diagram of theoretical comparison of mixing using 2 colored lights and 5 colored lights (4 colored lights are actually adopted, and the first compensation colored light and the second compensation colored light are selected from three basic colored lights (red, green and blue) according to the needs) and result comparison measured by the integrating ball in one embodiment.

The above method for computing illumination mixed lights can accurately compute the mixing ratio of 4 colored lights (the first colored light, the second colored light, the first compensation colored light and the second compensation colored light). The color tolerance of the target colored light obtained by mixing colors in practical applications according to the computed mixing ratio is less than 1SCDM, thereby greatly reducing the color tolerance and enhancing the color mixing effect. The method for computing illumination mixed lights is universal and applicable to any illumination product.

Figure 7:
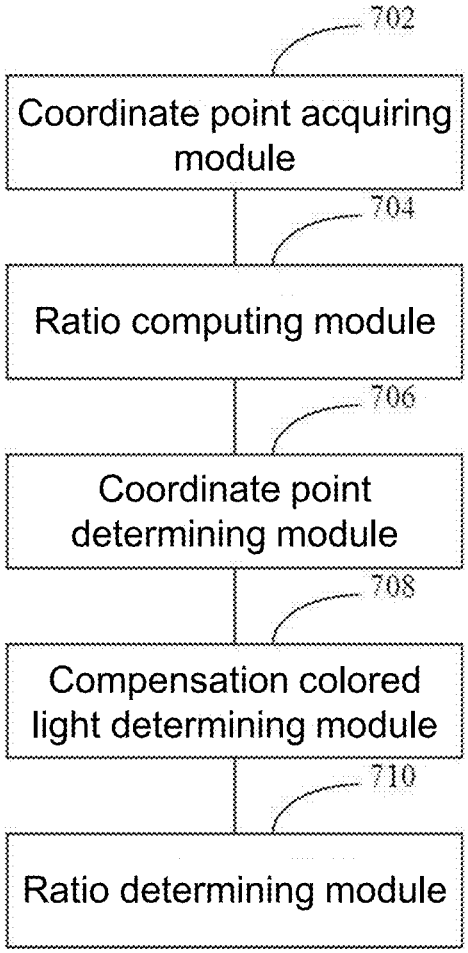
FIG. 7 is a structural block diagram of an apparatus for computing illumination mixed lights in one embodiment.

As shown in FIG. 7, an apparatus for computing illumination mixed lights is provided, including:

a coordinate point acquiring module 702 configured for acquiring a first chromaticity coordinate point corresponding to a first colored light and acquiring a second chromaticity coordinate point corresponding to a second colored light;

a ratio computing module 704 configured for acquiring a target chromaticity coordinate point and computing a first lumen mixing ratio of the first colored light and the second colored light according to the target chromaticity coordinate point, the first chromaticity coordinate point and the second chromaticity coordinate point;

a coordinate point determining module 706 configured for determining a middle chromaticity coordinate point corresponding to a middle-colored light obtained by mixing the first colored light and the second colored light according to the first lumen mixing ratio;

a compensation colored light determining module 708 configured for determining a first compensation colored light and a second compensation colored light which are matched with the middle chromaticity coordinate point according to the middle chromaticity coordinate point; and a ratio determining module 710 configured for conducting compensation computation on the middle colored light according to the first compensation colored light and the second compensation colored light and determining a second lumen mixing ratio corresponding to the first compensation colored light, the second compensation colored light and the middle colored light when mixed to the target chromaticity coordinate point.

In one embodiment, the compensation colored light determining module is also configured for acquiring a third chromaticity coordinate point corresponding to a third colored light, a fourth chromaticity coordinate point corresponding to a fourth colored light and a fifth chromaticity coordinate point corresponding to a fifth colored light; determining a color gamut range of the target chromaticity coordinate point according to the third chromaticity coordinate point, the fourth chromaticity coordinate point, the fifth chromaticity coordinate point and the middle chromaticity coordinate point; and selecting two colored lights as the first compensation colored light and the second compensation colored light from the third colored light, the fourth colored light and the fifth colored light according to the color gamut range.

In one embodiment, the compensation colored light determining module is also configured for respectively computing triangle areas formed by any three points of the third chromaticity coordinate point, the fourth chromaticity coordinate point, the fifth chromaticity coordinate point, the middle chromaticity coordinate point and the target chromaticity coordinate point; determining a target triangle area matched with the target chromaticity coordinate point according to the computed triangle areas; and using the target triangle area as the color gamut range corresponding to the target chromaticity coordinate point.

In one embodiment, the ratio determining module is also configured for acquiring a first compensation chromaticity coordinate point of the first compensation colored light, and acquiring a second compensation chromaticity coordinate point of the second compensation colored light; and determining a second lumen mixing ratio corresponding to the first compensation colored light, the second compensation colored light and the middle colored light when mixed to the target chromaticity coordinate point according to the first compensation chromaticity coordinate point, the second compensation chromaticity coordinate point and the middle chromaticity coordinate point.

Figure 8:
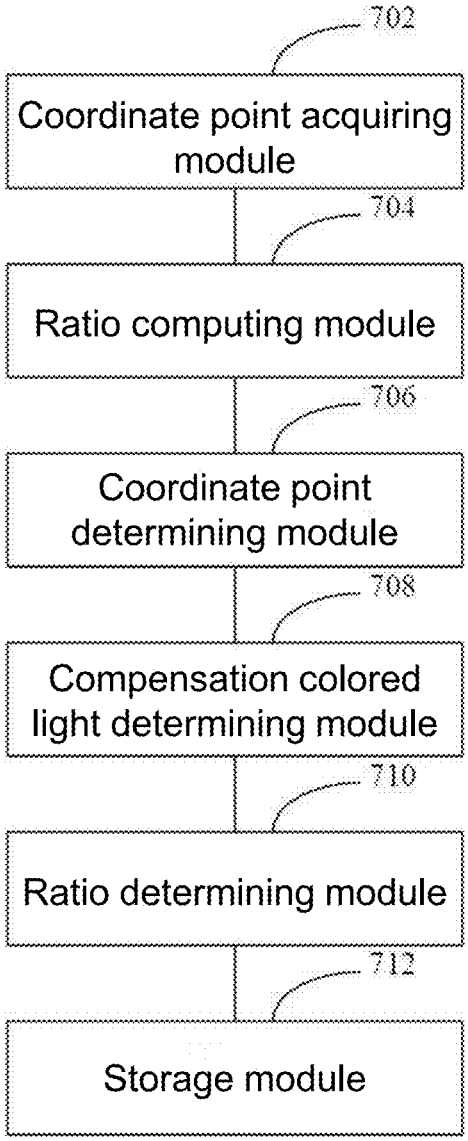
FIG. 8 is a structural block diagram of an apparatus for computing illumination mixed lights in another embodiment.

As shown in FIG. 8, in one embodiment, the above apparatus for computing illumination mixed lights further includes:

a storage module 712 configured for acquiring the color temperature corresponding to the target chromaticity coordinate point, and acquiring a mixing ratio of the first colored light, the second colored light, the first compensation colored light and the second compensation colored light corresponding to the target colored light; and conducting associative storage on the color temperature and the corresponding mixing ratio.

Figure 9:
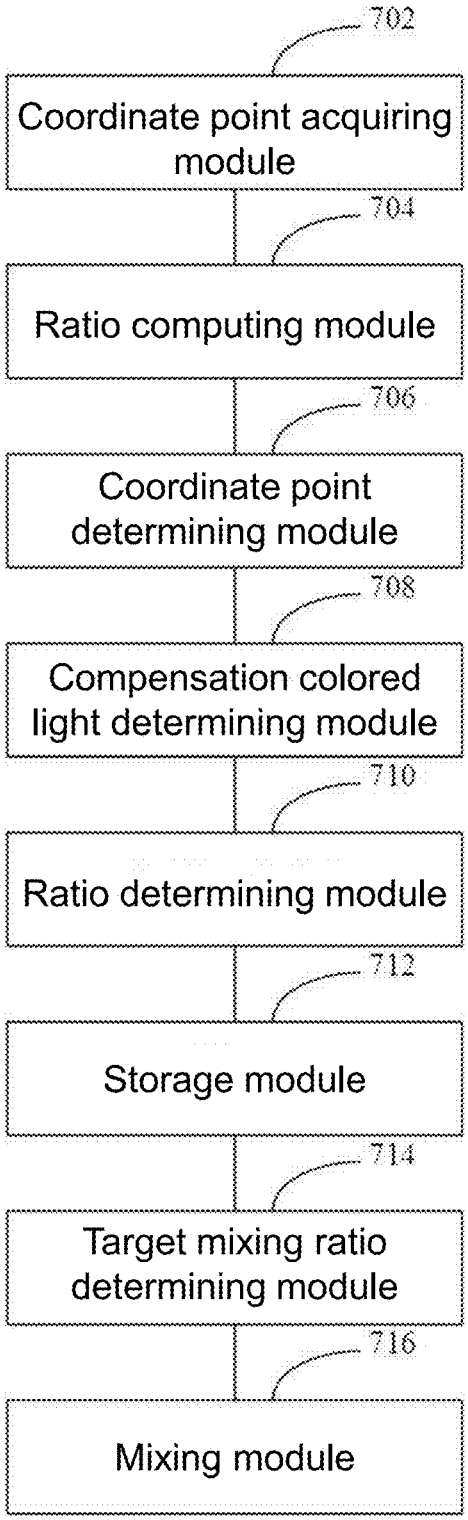
FIG. 9 is a structural block diagram of an apparatus for computing illumination mixed lights in another embodiment.

As shown in FIG. 9, in one embodiment, the above apparatus for computing illumination mixed lights further includes:

a target mixing ratio determining module 714 configured for determining a target color temperature corresponding to the current illumination according to a preset condition, and determining a target mixing ratio corresponding to the target color temperature according to the correspondence between the color temperature and the mixing ratio; and a mixing module 716 configured for mixing the first colored light, the second colored light, the first compensation colored light and the second compensation colored light according to the target mixing ratio to obtain the target colored light corresponding to the target color temperature.

In one embodiment, the coordinate point determining module is also configured for acquiring a target lumen value, and determining a first lumen value corresponding to the first colored light and a second lumen value corresponding to the second colored light according to the target lumen and the first lumen mixing ratio; and determining a middle chromaticity coordinate point corresponding to the middle colored light obtained by mixing the first colored light and the second colored light according to the first lumen and the second lumen.

Figure 10:
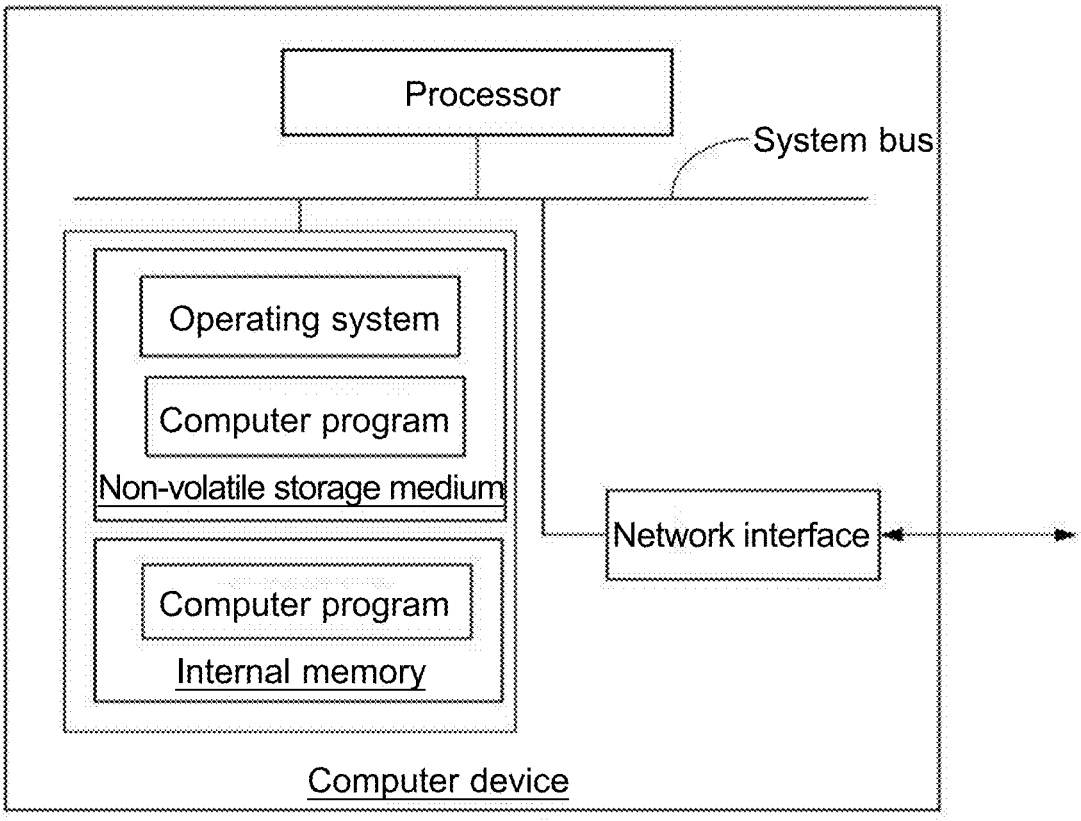
FIG. 10 is an internal structural diagram of a computer device in one embodiment.

FIG. 10 shows an internal structural diagram of a computer device in one embodiment. The computer device may be a server or a terminal. The server may be one server or a server cluster composed of a plurality of servers or a cloud server (cloud side server), etc. The terminal may be a desktop terminal or a mobile terminal. Specifically, the mobile terminal may be one of a mobile phone, a laptop, a tablet personal computer, a smart lamp, etc. As shown in FIG. 10, the computer device includes a processor, a memory and a network interface which are connected by a system bus, wherein the memory includes a non-volatile storage medium and an internal memory. The non-volatile storage medium of the computer device stores an operating system and may also store computer programs. When the computer programs are executed by the processor, the processor can realize the method for computing illumination mixed lights. The internal memory can also store the computer programs. When the computer programs are executed by the processor, the processor can execute the method for computing illumination mixed lights. The network interface is configured for communication with the outside. Those skilled in the art can understand that, the structure shown in FIG. 10 is only a block diagram of a partial structure related to the solution of the present application and does not limit the computer device to which the solution of the present application is applied. Specifically, the computer device may include more or fewer components than as shown in the diagram, or may combine certain components, or may have different component arrangements.

In one embodiment, the method for computing illumination mixed lights provided by the present application may be realized in the form of the computer programs which can be operated on the computer device shown in FIG. 10. The memory of the computer device may store each program template that constitutes the apparatus for computing illumination mixed lights, such as a coordinate point acquiring module 702, a ratio computing module 704, a coordinate point determining module 706, a compensation colored light determining module 708 and a ratio determining module 710.

Figure 11:
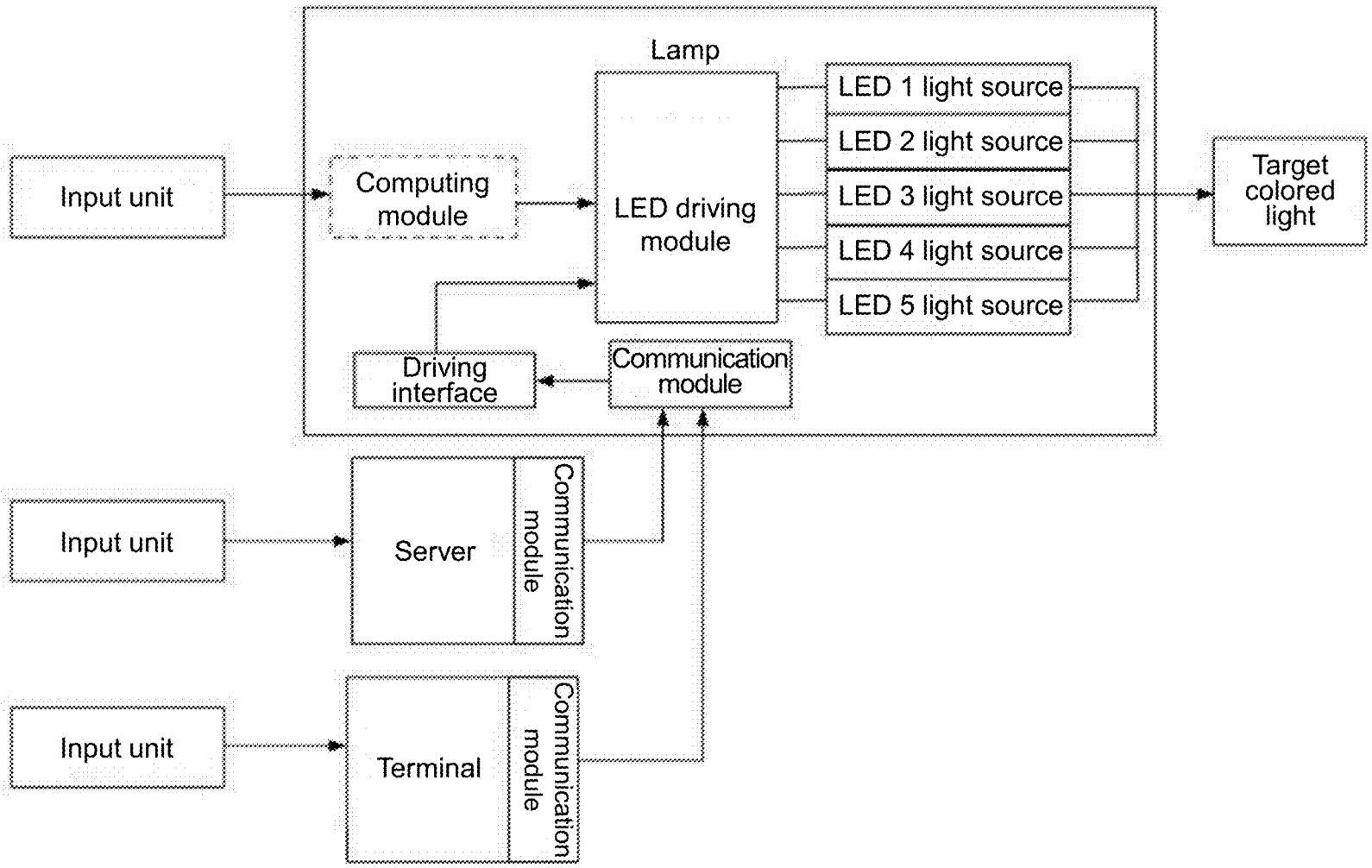
FIG. 11 is an application environment diagram of a method for computing illumination mixed lights in one embodiment.

FIG. 11 is an application scenario diagram of a method for computing illumination mixed lights in one embodiment. Three application scenarios are included in the figure. In one application scenario, a lamp includes a computing module. The lamp receives chromaticity coordinate points corresponding to LED light sources inputted by an input unit and a target chromaticity coordinate point. The computing module in the lamp can compute a mixing ratio corresponding to the target chromaticity coordinate point. Then, a driving module is invoked according to the light mixing ratio. The mixing ratio of five LED light sources is controlled by the driving module (actually, four LED light sources are involved, i.e., the mixing ratio of the remaining LED light source is 0). The mixing ratio is controlled to finally mix the target colored light.

In another application scenario, light mixing computation is conducted through the server (for example, the cloud server). The server acquires the chromaticity coordinate points corresponding to the LED light sources inputted by the input unit and the target chromaticity coordinate point, computes the mixing ratio corresponding to the target chromaticity coordinate point, and sends the obtained mixing ratio to the lamp through a communication module. Then, the lamp controls the LED light sources through the driving module.

In the last application scenario, light mixing computation is conducted through the terminal. The terminal receives the chromaticity coordinate points corresponding to the LED light sources inputted by the input unit and the target chromaticity coordinate point, computes the mixing ratio corresponding to the target chromaticity coordinate point, and sends the obtained mixing ratio to the lamp through a communication module. Then, the lamp controls the LED light sources through the driving module.

A computer device includes a memory and a processor, wherein the memory stores computer programs that, when executed by the processor, enable the processor to execute the steps of: acquiring a first chromaticity coordinate point corresponding to a first colored light, and acquiring a second chromaticity coordinate point corresponding to a second colored light; acquiring a target chromaticity coordinate point, and computing a first lumen mixing ratio of the first colored light and the second colored light according to the target chromaticity coordinate point, the first chromaticity coordinate point and the second chromaticity coordinate point; determining a middle chromaticity coordinate point corresponding to a middle colored light obtained by mixing the first colored light and the second colored light according to the first lumen mixing ratio; determining a first compensation colored light and a second compensation colored light which are matched with the middle chromaticity coordinate point according to the middle chromaticity coordinate point; and conducting compensation computation on the middle colored light according to the first compensation colored light and the second compensation colored light, and determining a second lumen mixing ratio corresponding to the first compensation colored light, the second compensation colored light and the middle colored light when mixed to the target chromaticity coordinate point.

In one embodiment, the step of determining a first compensation colored light and a second compensation colored light which are matched with the middle chromaticity coordinate point according to the middle chromaticity coordinate point includes: acquiring a third chromaticity coordinate point corresponding to a third colored light, a fourth chromaticity coordinate point corresponding to a fourth colored light and a fifth chromaticity coordinate point corresponding to a fifth colored light; determining a color gamut range of the target chromaticity coordinate point according to the third chromaticity coordinate point, the fourth chromaticity coordinate point, the fifth chromaticity coordinate point and the middle chromaticity coordinate point; and selecting two colored lights as the first compensation colored light and the second compensation colored light from the third colored light, the fourth colored light and the fifth colored light according to the color gamut range.

In one embodiment, the step of determining a color gamut range of the target chromaticity coordinate point according to the third chromaticity coordinate point, the fourth chromaticity coordinate point, the fifth chromaticity coordinate point and the middle chromaticity coordinate point includes: respectively computing triangle areas formed by any three points of the third chromaticity coordinate point, the fourth chromaticity coordinate point, the fifth chromaticity coordinate point, the middle chromaticity coordinate point and the target chromaticity coordinate point; determining a target triangle area matched with the target chromaticity coordinate point according to the computed triangle areas; and using the target triangle area as the color gamut range corresponding to the target chromaticity coordinate point.

In one embodiment, the steps of conducting compensation computation on the middle colored light according to the first compensation colored light and the second compensation colored light and determining a second lumen mixing ratio corresponding to the first compensation colored light, the second compensation colored light and the middle colored light when mixed to the target chromaticity coordinate point includes: acquiring a first compensation chromaticity coordinate point of the first compensation colored light, and acquiring a second compensation chromaticity coordinate point of the second compensation colored light; and determining a second lumen mixing ratio corresponding to the first compensation colored light, the second compensation colored light and the middle colored light when mixed to the target chromaticity coordinate point according to the first compensation chromaticity coordinate point, the second compensation chromaticity coordinate point and the middle chromaticity coordinate point.

In one embodiment, the above computer programs, when executed by the processor, are also configured for executing the steps of: acquiring a color temperature corresponding to the target chromaticity coordinate point, and acquiring a mixing ratio of the first colored light, the second colored light, the first compensation colored light and the second compensation colored light corresponding to the target colored light; and conducting associative storage on the color temperature and the corresponding mixing ratio.

In one embodiment, the above computer programs, when executed by the processor, are also configured for executing the steps of: determining a target color temperature corresponding to the current illumination according to a preset condition, and determining a target mixing ratio corresponding to the target color temperature according to the correspondence between the color temperature and the mixing ratio; and mixing the first colored light, the second colored light, the first compensation colored light and the second compensation colored light according to the target mixing ratio to obtain the target colored light corresponding to the target color temperature.

In one embodiment, the step of determining a middle chromaticity coordinate point corresponding to a middle colored light obtained by mixing the first colored light and the second colored light according to the first lumen mixing ratio includes: acquiring a target lumen value, and determining a first lumen value corresponding to the first colored light and a second lumen value corresponding to the second colored light according to the target lumen and the first lumen mixing ratio; and determining a middle chromaticity coordinate point corresponding to the middle colored light obtained by mixing the first colored light and the second colored light according to the first lumen and the second lumen.

A computer readable storage medium stores computer programs that, when executed by the processor, enable the processor to execute the steps of:

acquiring a first chromaticity coordinate point corresponding to a first colored light, and acquiring a second chromaticity coordinate point corresponding to a second colored light; acquiring a target chromaticity coordinate point, and computing a first lumen mixing ratio of the first colored light and the second colored light according to the target chromaticity coordinate point, the first chromaticity coordinate point and the second chromaticity coordinate point; determining a middle chromaticity coordinate point corresponding to a middle colored light obtained by mixing the first colored light and the second colored light according to the first lumen mixing ratio; determining a first compensation colored light and a second compensation colored light which are matched with the middle chromaticity coordinate point according to the middle chromaticity coordinate point; and conducting compensation computation on the middle colored light according to the first compensation colored light and the second compensation colored light, and determining a second lumen mixing ratio corresponding to the first compensation colored light, the second compensation colored light and the middle colored light when mixed to the target chromaticity coordinate point.

In one embodiment, the step of determining a first compensation colored light and a second compensation colored light which are matched with the middle chromaticity coordinate point according to the middle chromaticity coordinate point includes: acquiring a third chromaticity coordinate point corresponding to a third colored light, a fourth chromaticity coordinate point corresponding to a fourth colored light and a fifth chromaticity coordinate point corresponding to a fifth colored light; determining a color gamut range of the target chromaticity coordinate point according to the third chromaticity coordinate point, the fourth chromaticity coordinate point, the fifth chromaticity coordinate point and the middle chromaticity coordinate point; and selecting two colored lights as the first compensation colored light and the second compensation colored light from the third colored light, the fourth colored light and the fifth colored light according to the color gamut range.

In one embodiment, the step of determining a color gamut range of the target chromaticity coordinate point according to the third chromaticity coordinate point, the fourth chromaticity coordinate point, the fifth chromaticity coordinate point and the middle chromaticity coordinate point includes: respectively computing triangle areas formed by any three points of the third chromaticity coordinate point, the fourth chromaticity coordinate point, the fifth chromaticity coordinate point, the middle chromaticity coordinate point and the target chromaticity coordinate point; determining a target triangle area matched with the target chromaticity coordinate point according to the computed triangle areas; and using the target triangle area as the color gamut range corresponding to the target chromaticity coordinate point.

In one embodiment, the steps of conducting compensation computation on the middle colored light according to the first compensation colored light and the second compensation colored light and determining a second lumen mixing ratio corresponding to the first compensation colored light, the second compensation colored light and the middle colored light when mixed to the target chromaticity coordinate point includes: acquiring a first compensation chromaticity coordinate point of the first compensation colored light, and acquiring a second compensation chromaticity coordinate point of the second compensation colored light; and determining a second lumen mixing ratio corresponding to the first compensation colored light, the second compensation colored light and the middle colored light when mixed to the target chromaticity coordinate point according to the first compensation chromaticity coordinate point, the second compensation chromaticity coordinate point and the middle chromaticity coordinate point.

In one embodiment, the above computer programs, when executed by the processor, are also configured for executing the steps of: acquiring a color temperature corresponding to the target chromaticity coordinate point, and acquiring a mixing ratio of the first colored light, the second colored light, the first compensation colored light and the second compensation colored light corresponding to the target colored light; and conducting associative storage on the color temperature and the corresponding mixing ratio.

In one embodiment, the above computer programs, when executed by the processor, are also configured for executing the steps of: determining a target color temperature corresponding to the current illumination according to a preset condition, and determining a target mixing ratio corresponding to the target color temperature according to the correspondence between the color temperature and the mixing ratio; and mixing the first colored light, the second colored light, the first compensation colored light and the second compensation colored light according to the target mixing ratio to obtain the target colored light corresponding to the target color temperature.

In one embodiment, the step of determining a middle chromaticity coordinate point corresponding to a middle colored light obtained by mixing the first colored light and the second colored light according to the first lumen mixing ratio includes: acquiring a target lumen value, and determining a first lumen value corresponding to the first colored light and a second lumen value corresponding to the second colored light according to the target lumen and the first lumen mixing ratio; and determining a middle chromaticity coordinate point corresponding to the middle colored light obtained by mixing the first colored light and the second colored light according to the first lumen and the second lumen.

Those ordinary skilled in the art can understand that the realization of all or part of the processes in the above embodiment method may be completed by instructing the relevant hardware through the computer programs. The programs can be stored in a non-volatile computer readable storage medium. The programs, when executed, can include the processes in the above method embodiments. Any reference to the memory, the storage medium, a database or other media used in each embodiment provided in the present application may include a non-volatile and/or volatile memory. The non-volatile memory may include a read-only memory (ROM), a programmable ROM (PROM), an electrically programmable ROM (EPROM), an electrically erasable programmable ROM (EEPROM), or a flash memory. The volatile memory may include a random access memory (RAM) or an external cache memory. As an illustration rather than a limitation, RAM is available in many forms, such as static RAM (SRAM), dynamic RAM (DRAM), synchronous DRAM (SDRAM), double data rate SDRAM (DDRSDRAM), enhanced SDRAM (ESDRAM), Synchlink DRAM (SLDRAM), Rambus direct RAM (RDRAM), direct rambus dynamic RAM (DRDRAM) and rambus dynamic RAM(RDRAM).

The technical features of the above embodiments may be combined in any manner. For simplicity of description, all possible combinations of the technical features in the above embodiments are not described. However, as long as there is no contradiction in the combination of these technical features, these technical features shall be considered as the scope recorded in the Description.

The above embodiments only express several implementation modes of the present application, and are described more specifically in detail, but shall not be consequently interpreted as a limitation to the scope of the patent for the present application. It should be noted that, for those ordinary skilled in the art, several variations and improvements can also be made without departing from the concept of the present application, all of which belong to the protection scope of the present application. Therefore, the protection scope of the patent for the present application shall be subject to appended claims.

What is claimed is:

1. A method for computing illumination mixed lights from a light source, comprising:

acquiring a first chromaticity coordinate point corresponding to a first colored light, and acquiring a second chromaticity coordinate point corresponding to a second colored light;

acquiring a target chromaticity coordinate point, and computing a first lumen mixing ratio of the first colored light and the second colored light according to the target chromaticity coordinate point, the first chromaticity coordinate point and the second chromaticity coordinate point;

determining a middle chromaticity coordinate point corresponding to a middle-colored light obtained by mixing the first colored light and the second colored light according to the first lumen mixing ratio;

determining a first compensation colored light and a second compensation colored light according to the middle chromaticity coordinate point and the target chromaticity coordinate point; and conducting compensation computation on the middle-colored light according to the first compensation colored light and the second compensation colored light, and determining a second lumen mixing ratio corresponding to the first compensation colored light, the second compensation colored light and the middle colored light to become the target chromaticity coordinate point.

2. The method according to claim 1, wherein the step of determining the first compensation colored light and the second compensation colored light according to the middle chromaticity coordinate point and the target chromaticity coordinate point comprises:

acquiring a third chromaticity coordinate point corresponding to a third colored light, a fourth chromaticity coordinate point corresponding to a fourth colored light and a fifth chromaticity coordinate point corresponding to a fifth colored light;

determining a color gamut range of the target chromaticity coordinate point according to the third chromaticity coordinate point, the fourth chromaticity coordinate point, the fifth chromaticity coordinate point and the middle chromaticity coordinate point; and selecting two colored lights as the first compensation colored light and the second compensation colored light from the third colored light, the fourth colored light and the fifth colored light according to the color gamut range.

3. A computer device, comprising a memory and a processor, wherein the memory stores computer programs that, when executed by the processor, enable the processor to execute steps of the method in claim 2.

4. The method according to claim 2, wherein the step of determining the color gamut range of the target chromaticity coordinate point according to the third chromaticity coordinate point, the fourth chromaticity coordinate point, the fifth chromaticity coordinate point and the middle chromaticity coordinate point comprises:

respectively computing triangle areas formed by any three points of the third chromaticity coordinate point, the fourth chromaticity coordinate point, the fifth chromaticity coordinate point, the middle chromaticity coordinate point and the target chromaticity coordinate point;

determining a target triangle area matched with the target chromaticity coordinate point according to the computed triangle areas; and using the target triangle area as the color gamut range corresponding to the target chromaticity coordinate point.

5. A computer device, comprising a memory and a processor, wherein the memory stores computer programs that, when executed by the processor, enable the processor to execute steps of the method in claim 4.

6. The method according to claim 1, wherein the steps of conducting compensation computation on the middle colored light according to the first compensation colored light and the second compensation colored light and determining the second lumen mixing ratio corresponding to the first compensation colored light, the second compensation colored light and the middle colored light to become the target chromaticity coordinate point comprises:

acquiring a first compensation chromaticity coordinate point of the first compensation colored light, and acquiring a second compensation chromaticity coordinate point of the second compensation colored light; and determining a second lumen mixing ratio corresponding to the first compensation colored light, the second compensation colored light and the middle-colored light to become the target chromaticity coordinate point according to the first compensation chromaticity coordinate point, the second compensation chromaticity coordinate point and the middle chromaticity coordinate point.

7. A computer device, comprising a memory and a processor, wherein the memory stores computer programs that, when executed by the processor, enable the processor to execute steps of the method in claim 6.

8. The method according to claim 1, wherein the method further comprises:

acquiring a color temperature corresponding to the target chromaticity coordinate point, and acquiring a mixing ratio of the first colored light, the second colored light, the first compensation colored light and the second compensation colored light corresponding to the target colored light; and storing the color temperature and the corresponding mixing ratio.

9. The method according to claim 8, wherein the method further comprises:

determining a target color temperature corresponding to the current illumination according to a preset condition, and determining a target mixing ratio corresponding to the target color temperature according to the correspondence between the color temperature and the mixing ratio; and mixing the first colored light, the second colored light, the first compensation colored light and the second compensation colored light according to the target mixing ratio to obtain the target colored light corresponding to the target color temperature.

10. A computer device, comprising a memory and a processor, wherein the memory stores computer programs that, when executed by the processor, enable the processor to execute steps of the method in claim 9.

11. A computer device, comprising a memory and a processor, wherein the memory stores computer programs that, when executed by the processor, enable the processor to execute steps of the method in claim 8.

12. The method according to claim 1, wherein the step of determining a middle chromaticity coordinate point corresponding to a middle-colored light obtained by mixing the first colored light and the second colored light according to the first lumen mixing ratio comprises:

acquiring a target lumen value, and determining a first lumen value corresponding to the first colored light and a second lumen value corresponding to the second colored light according to the target lumen and the first lumen mixing ratio; and determining a middle chromaticity coordinate point corresponding to the middle-colored light obtained by mixing the first colored light and the second colored light according to the first lumen and the second lumen.

13. A computer device, comprising a memory and a processor, wherein the memory stores computer programs that, when executed by the processor, enable the processor to execute steps of the method in claim 12.

14. A computer device, comprising a memory and a processor, wherein the memory stores computer programs that, when executed by the processor, enable the processor to execute steps of the method in claim 1.

15. An apparatus for computing illumination mixed lights, comprising:

a processor, configured to:

acquire a first chromaticity coordinate point corresponding to a first colored light and acquiring a second chromaticity coordinate point corresponding to a second colored light;

acquire a target chromaticity coordinate point and computing a first lumen mixing ratio of the first colored light and the second colored light according to the target chromaticity coordinate point, the first chromaticity coordinate point and the second chromaticity coordinate point;

determine a middle chromaticity coordinate point corresponding to a middle-colored light obtained by mixing the first colored light and the second colored light according to the first lumen mixing ratio;

determine a first compensation colored light and a second compensation colored light according to the middle chromaticity coordinate point and the target chromaticity coordinate point; and conduct compensation computation on the middle colored light according to the first compensation colored light and the second compensation colored light and determining a second lumen mixing ratio corresponding to the first compensation colored light, the second compensation colored light and the middle colored light to become the target chromaticity coordinate point.

* * * * *